US009089017B2

(12) United States Patent
Pang et al.

(10) Patent No.: US 9,089,017 B2
(45) Date of Patent: Jul. 21, 2015

(54) METHOD OF CONTROLLING LIGHTS AND CONTROLLER THEREFOR

(75) Inventors: Yin Hung Pang, Chaiwan (HK); Man Yin Arthur Newton Chu, Aberdeen (HK)

(73) Assignee: DEFOND COMPONENTS LIMITED, Chaiwan (HK)

( * ) Notice: Subject to any disclaimer, the term of this patent is extended or adjusted under 35 U.S.C. 154(b) by 1266 days.

(21) Appl. No.: 12/958,515

(22) Filed: Dec. 2, 2010

(65) Prior Publication Data

US 2012/0139450 A1 Jun. 7, 2012

(51) Int. Cl.

| | |
|---|---|
| ***H05B 37/00*** | (2006.01) |
| ***H05B 37/02*** | (2006.01) |
| ***H05B 33/08*** | (2006.01) |

(52) U.S. Cl.

CPC ..... *H05B 37/029* (2013.01); *H05B 33/0842* (2013.01); *H05B 37/0254* (2013.01)

(58) Field of Classification Search

CPC ..... H05B 37/029; H05B 33/0842; H05B 37/0254

USPC ..... 315/312, 151, 149, 158, 307, 295, 291

See application file for complete search history.

(56) References Cited

U.S. PATENT DOCUMENTS

| | | | | |
|---|---|---|---|---|
| 6,459,919 | B1 * | 10/2002 | Lys et al. | 600/407 |
| 6,608,453 | B2 * | 8/2003 | Morgan et al. | 315/312 |
| 2008/0136334 | A1 * | 6/2008 | Robinson et al. | 315/151 |
| 2008/0297068 | A1 * | 12/2008 | Koren et al. | 315/297 |
| 2009/0231159 | A1 * | 9/2009 | Selevan | 340/907 |
| 2010/0060194 | A1 | 3/2010 | Furry et al. | |

FOREIGN PATENT DOCUMENTS

WO WO 02/098182 A2 12/2002

OTHER PUBLICATIONS

European Patent Office, Search Report in European Patent Application No. EP 11 25 0912 (Sep. 29, 2014).

European Patent Office, Office Action in European Patent Application No. EP 11 25 0912 (Sep. 29, 2014).

* cited by examiner

*Primary Examiner* — Tung X Le
*Assistant Examiner* — Amy Yang
(74) *Attorney, Agent, or Firm* — Leydig, Voit & Mayer, Ltd.

(57) ABSTRACT

A method of controlling respective intensity levels of each of N light units, from a first light unit to an Nth light unit. Each of the light units has respective intensity levels from a 0 level to an L level based on duration of illumination of each light unit, In the method, a control signal representing light intensities for each of the N light units, sequentially, in order, for the first light unit to Nth light unit is received and processed. Then, the light units are re-arranged in accordance with the light intensities into a re-arranged order, from level L to level 0. A predetermined time period is counted sequentially through L time intervals. The light units are turned on in the re-arranged order at respective time intervals corresponding to the light intensities; and all light units are turned off at the end of the predetermined time period.

23 Claims, 4 Drawing Sheets

| Channel num. | Received |
|---|---|
| 1 | 125 |
| 2 | 125 |
| 3 | 235 |
| ... | ... |
| ... | ... |
| 17 | 202 |
| 18 | 188 |

Timing cycle

| Channel num | Light intensity |
|---|---|
| 1 | **20** |
| 2 | **90** |
| 3 | **135** |
| 4 | **255** |
| 5 | **230** |
| 6 | **50** |
| 7 | **230** |
| 8 | **90** |

Sorting and transformer to

| Light intensity | Channel num |
|---|---|
| 255 | 4 |
| 230 | 5 |
| 230 | 7 |
| 135 | 3 |
| 90 | 2 |
| 90 | 8 |
| 50 | 6 |
| 20 | 1 |

| At Time (light intensity) | Light up channel number | Pin 1 ..... Pin 8 |
|---|---|---|
| 255 | 4 | 0001 0000 |
| 230 | 5 & 7 | 0001 1010 |
| 135 | 3 | 0011 1010 |
| 90 | 2 & 8 | 0111 1011 |
| 50 | 6 | 0111 1011 |
| 20 | 1 | 1111 1111 |
| 0 | Reset all channels | 0000 0000 |

METHOD OF CONTROLLING LIGHTS AND CONTROLLER THEREFOR

The present invention relates to a method of controlling lights and in particular, but not exclusively, a light display or effect based on the DMX512 protocol, and a controller therefor.

BACKGROUND OF THE INVENTION

DMX512 is a standard protocol for digital communication networks to control stage lighting and effects, as known for example from http://en.wikipedia.org/wiki/DMX512.

DMX512 was originally designed as a standardized method for controlling light dimmers, which replaced various incompatible proprietary protocols employed previously. However, it soon became the primary method for linking not only controllers and dimmers, but also more advanced fixtures and special effects devices such as fog machines and moving lights.

As to the protocol, at the data-link layer, a DMX512 controller transmits asynchronous serial data at 250 kbaud. The data format is fixed at one start bit, eight data bits, two stop bits and no parity. The start of a packet is signified by a break followed by a logical "mark", known as the "Mark after Break". The break, which signals the end of one packet and the start of another, causes receivers to start reception and also serves as a frame (position reference) for data bytes within the packet. Framed data bytes are known as slots. Following the break, up to 513 slots may be sent.

The first slot is reserved for a "Start Code" that specifies the type of data in the packet. A start code of 0x00 (hexadecimal zero) is the standard value used for all DMX512 compatible devices, which includes most lighting fixtures and dimmers.

All slots following the start code contain control settings for slave devices. A slot's position within the packet determines the device and function to be controlled, while its data value specifies the control set point. Multi-byte data values are conveyed in little endian format in adjacent slots.

As the number of lights controlled increases and/or light patterns generated by the lights become more complicate or change more rapidly, massive MCU timing and resources are consumed. The correspondingly heavier data traffic also compromises the signal communication and processing. Amongst other adverse results, the quality of the light pattern deteriorates by, for example, occasional jitters, flickering or unstable lighting.

The invention seeks to mitigate or at least alleviate such a problem by providing a new or otherwise improved control method and controller therefor.

SUMMARY OF THE INVENTION

According to a first aspect of the invention, there is provided a control method of controlling a plurality of, N 1st to Nth light units each of a light intensity variable in the range from levels 0 to L based on light up duration, comprising the steps of:

- receiving and processing a control signal representing a series of N intended light intensities for the light units sequentially in the order from the 1st to Nth light units;
- re-arranging the light units by their intended light intensities in a re-arranged order from level L to level 0;
- counting a predetermined time period sequentially through L time intervals;

- turning on the light units as appropriate in the re-arranged order at respective said time intervals, corresponding to their intended light intensities; and
- turning off all light units at the end of the predetermined time period.

Preferably, the light intensity at level 0 represents zero light up duration, and the light intensity at level L represents maximum light up duration which is the predetermined time period.

It is preferred that the step of counting a said predetermined time period comprises counting down the predetermined time period to zero.

Preferably, the step of turning on the light units includes turning on the light units based on pulse width modulation.

It is preferred that the step of turning on the light units includes turning on the light units at the start of respective said time intervals.

Preferably, the control method includes repeating the steps sequentially in cycles.

It is preferred that levels 0 to L of the light intensity range from 0 to 255.

In a preferred embodiment, the control method is programmed to control thirty-six light units which are arranged in twelve ports each of three light units in red, green and blue.

Preferably, each light unit comprises at least one string of light emitting diodes.

It is preferred that the control method includes using an MCU for performing the steps, the MCU having a respective output pin for controlling each of the light units.

Preferably, the control method includes using a master MCU for receiving and processing a said control signal and a slave MCU for performing the other steps.

More preferably, the control method includes using a pair of said slave MCUs for performing the other steps, each MCU being for controlling half of the light units.

According to a second aspect of the invention, there is provided a controller for controlling a plurality of, N 1st to Nth light units each of a light intensity variable in the range from levels 0 to L based on light up duration, comprising:

- a processor for receiving and processing a control signal representing a series of N intended light intensities for the light units sequentially in the order from the 1st to Nth light units;
- a processor for re-arranging the light units by their intended light intensities in a re-arranged order from level L to level 0;
- a counter for counting a predetermined time period sequentially through L time intervals; and
- an operator for turning on the light units as appropriate in the re-arranged order at respective said time intervals, corresponding to their intended light intensities, and subsequently turning off all light units at the end of the predetermined time period.

Preferably, the light intensity at level 0 represents zero light up duration, and the light intensity at level L represents maximum light up duration which is the predetermined time period.

It is preferred that the counter counts down the predetermined time period to zero.

Preferably, the operator turns on the light units based on pulse width modulation.

It is preferred that the operator turns on the light units at the start of respective said time intervals.

Preferably, levels 0 to L of the light intensity range from 0 to 255.

In a preferred embodiment, the second processor has thirty-six channels arranged in twelve ports each for three light units in red, green and blue.

It is preferred that each light unit comprises at least one string of light emitting diodes.

Preferably, the processors are provided by an MCU having a respective output pin for controlling each of the light units.

It is preferred that the processors are provided by a master MCU for receiving and processing a said control signal and a slave MCU acting as the second processor, the counter and the operator.

It is further preferred that the second processor is provided by a pair of said slave MCUs, each for controlling half of the light units.

BRIEF DESCRIPTION OF DRAWINGS

The invention will now be more particularly described, by way of example only, with reference to the accompanying drawings, in which.

DETAILED DESCRIPTION OF PREFERRED EMBODIMENTS

Figure 1:
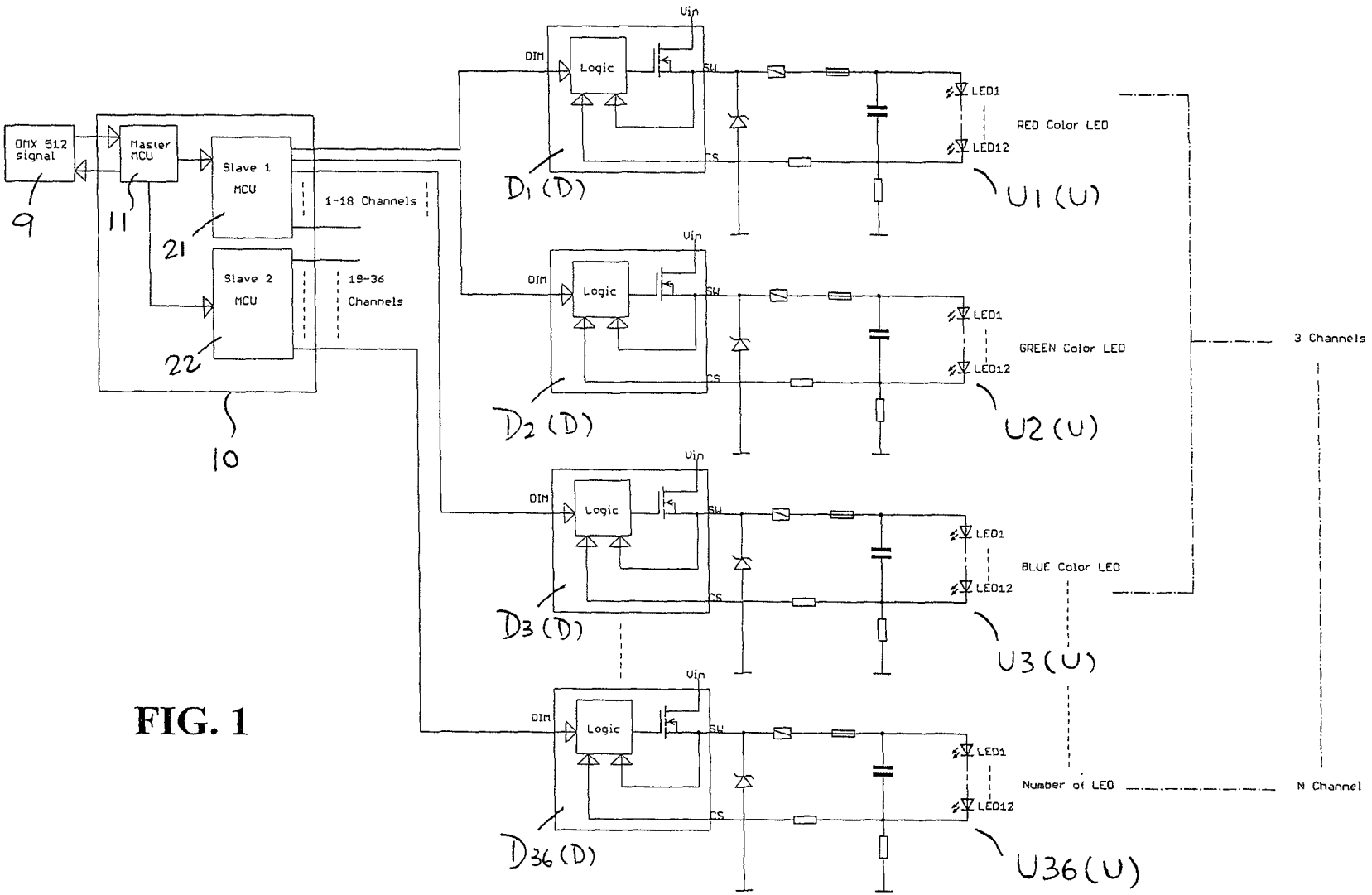
FIG. 1 is a schematic functional block diagram of a light control system which incorporates a controller using a control method, both as embodiments in accordance with the invention, for controlling a plurality of light units.

Referring to the drawings, there is shown a controller 10 using a control method, both embodying the invention, in a light control system for controlling a plurality of, for example, thirty-six light units U1 to U36, or U generally. The light units U1 to U36 are arranged in twelve ports each of three light units for emitting light in colour red, green and blue. Each light unit U takes the form of at least one string of twelve light emitting diodes (LEDs), and is operable at a light intensity that is variable in the range from levels 0 to L based on the duration during which the light unit U lights up, i.e. the light up duration.

In these embodiments, levels 0 to L of the light intensity range from 0 to 255, i.e. 256 levels in total, with the light intensity at level 0 representing zero light up duration and the light intensity at level L (level 255) representing maximum light up duration. The maximum light up duration is a predetermined time period, which is about 4 ms (milliseconds). One $255^{th}$ of this time period is about 0.016 ms.

The controller 10 may be implemented by one or more MCU to perform the major control functions and steps. The term "MCU" encompasses microprocessor control unit, microcontroller unit, microcontrol unit or micro computer unit, as alternative options.

In the present embodiment, the controller 10 incorporates a master MCU 11 and a pair of slave MCUs 21 and 22 connected in parallel to the output of the master MCU 11. The master MCU is programmed to receive and process, including decoding, a standard DMX512 control signal from an external source 9. The master MCU 11 also talks back to the external source 9. The control signal includes serial data representing a series of thirty-six intended light intensities for the light units U, sequentially in the order from the $1^{st}$ light unit U1 to the last $36^{th}$ light unit U36, for the forthcoming next cycle of operation.

Each slave MCU 21/22 has eighteen output pins operable to control half of the thirty-six light units U1 to U36, with the first MCU 21 controlling the light units U1 to U18 and the second MCU 22 responsible for the remaining light units U19 to U36. The pins are connected via respective driver circuits D1 to D36 (generally D) to the light units U1 to U36, each for turning on and off and driving the associated light unit U at the desired light intensity for the next cycle.

The drivers D may be implemented by logic light dimmer circuits for chopping and limiting current so as to drive the light units U. Certain protection and stabilizer circuit components are used as shown in FIG. 1. Each pin represents a channel for the associated driver D and light unit U downstream, and acts as an operator operating the associated channel.

The controller 10 is a device which receives standard DMX512 signals and controls the light intensity of each channel i.e. light units U1 to U36 in the form of LED light strings. It can drive up to twelve ports, each port consisting of three channels, with each channel connected to red, green and blue LED light strings respectively. A total number of thirty-six channels of LED light strings operating at different intensities may be controlled at the same time. The light intensity of each light string or unit U is controlled by Pulse Width Modulation (PWM) technique.

The controller 10 receives and decodes the DMX512 signal and manages the PWM outputs for all the channels or light units U simultaneously. It would incur a massive MCU workload, in order to improve the overall performance and avoid jitter due to MCU overloading or frequently interrupt come in, a Master-and-Slaves approach as implemented by the master and slave MCU 11, 21 and 22 is employed to participant the loading through parallel data processing.

The master MCU 11 is responsible for receiving the DMX512 signal, and then encodes it and dispatches the signal (i.e. intensities) to the slave MCUs 21 and 22. The reason for segregating the slave MCU into two, i.e. employing a pair of slave MCUs 21 and 22, is to minimize communication time with the master MCU 11. The master MCU 11 dispatches one byte light intensity signal, i.e. levels 0 to 255, to the slave MCUs sequentially, without sending IP addresses or device IDs for light units U1 to U36. The first eighteen channels are processed by the first slave MCU 21 and the rest of eighteen channels by the second slave MCU 22.

Figures 2, 3:
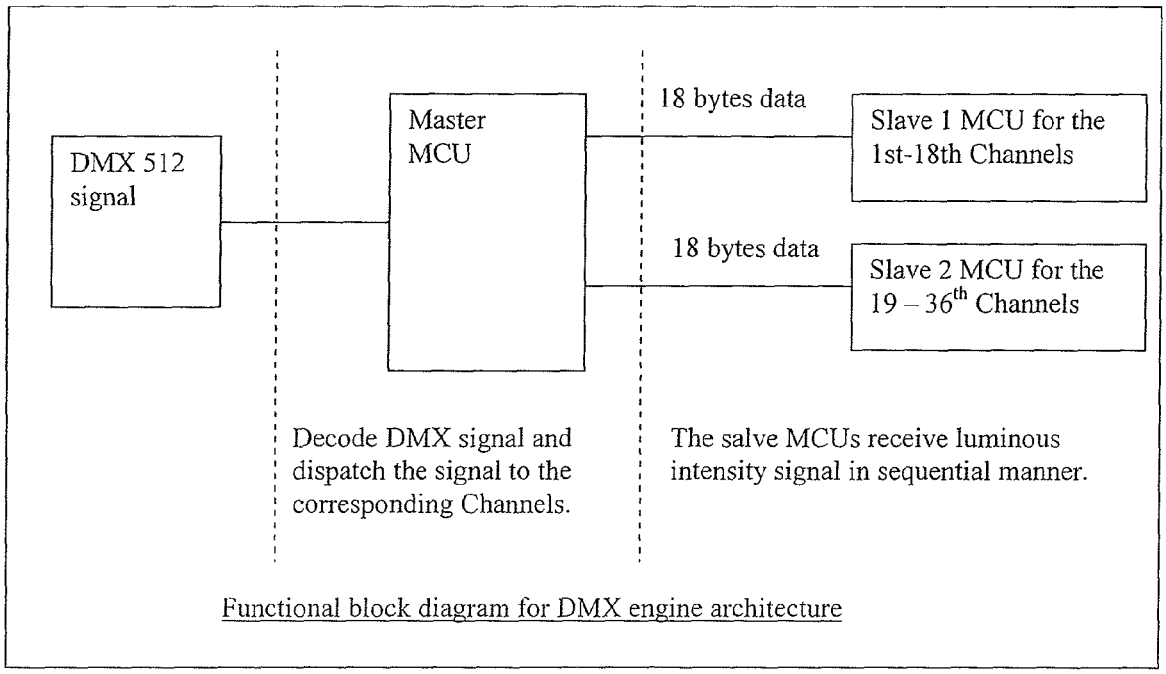
FIG. 2 is a schematic functional block diagram of the controller of FIG. 1, which incorporates a master MCU and a pair of slave MCUs.
FIG. 3 is a table showing signals of different light intensities intended for some of the light units received via respective channels by one slave MCU of FIG. 2.

Each slave MCU 21/22 first receives the light intensities in a single byte signal which represents levels 0 to 255, in that level 0 denotes zero intensity or "OFF" and level 255 denotes maximum intensity or fully "ON". In order to minimize the communication time, channel numbers will not be sent. The master MCU 11 only sends and each slave MCU 21/22 only receives the channel intensities in sequential order from the first light unit U1 to the last light unit U36, as shown in the table of FIG. 3 for the slave MCU 21.

The slave MCUs 21 and 22 are programmed to perform the following three main processes in each operating cycle, every 4.4 ms:

(a) Receiving from the master MCU 11 signals/data relating to individual channel intensities;

(b) Preparing a "light up" table by sorting and grouping operation upon the intensity/channel data; and (c) conducting PWM control process to control the individual light units U1 to U36 according to the "Light Up" table.

Figures 4, 5, 6:
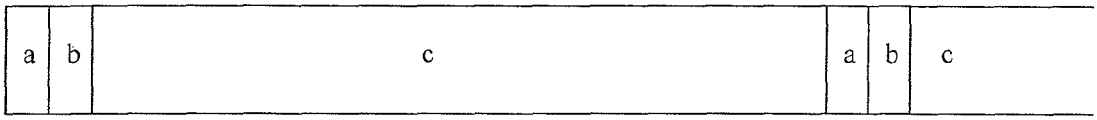
FIG. 4 is a schematic timing cycle diagram for the operation of the said slave MCU of FIG. 2.
FIG. 5 is an example of a table showing signals of different light intensities received via some of the channels.
FIG. 6 is a "light up" table converted from the table of FIG. 5 by the said slave MCU of FIG. 2.

The timing cycle of these three processes is shown in FIG. 4.

In process (a), the received signals are or represent a series of thirty-six intended light intensities for the light units U sequentially in the order from the $1^{st}$ to $36^{th}$ light units U1 to U36.

In process (b), each slave MCU 21/22 performs bubble sorting in the descending order such that higher lighting intensities will be popped up in the front as a down counter timer is used. In effect, the MCU 21/22 re-arranges the channels i.e. light units U1 to U36 by their intended light intensities in a re-arranged order from level 255 to level 0. This is done on the basis that as a higher intensity requires a longer light up time, the associated light unit U should be turned on earlier. After some logic calculations, the light up is complied and stored in a register, which will be updated every cycle.

Process (c) takes slightly shorter than 4.4 ms and the duration or time period is divided into 255 segments or time intervals. With the help of a counter counting the time period sequentially through the 255 time intervals, counting down from 255 to zero, each slave MCU 21/22 sets its various output pins to logic high at the start of the respective time intervals, thereby triggering the drivers D1 to D36 to turn on the associated light units U1 to U36, as appropriate, according to the re-arranged order in the "light up" table. The slave MCUs 21 and 22 subsequently turn off all light units U at the end of the time period.

The control method continues with the described operations and steps repeated sequentially in cycles, to generate a changing light pattern or image, for stage lighting, display or even as a screen showing video/text.

An example of the control method for eight channels is now described for better understanding.

Light intensity signals 20, 90, 135, 255,230, 50, 230 and 90 are received from the master MCU 11, as shown in the table of FIG. 5. The slave MCU 21/22 then re-arranges the order of the signals based on the light intensities in the descending order, thereby compiling the light up table of FIG. 6.

Figures 7, 8:
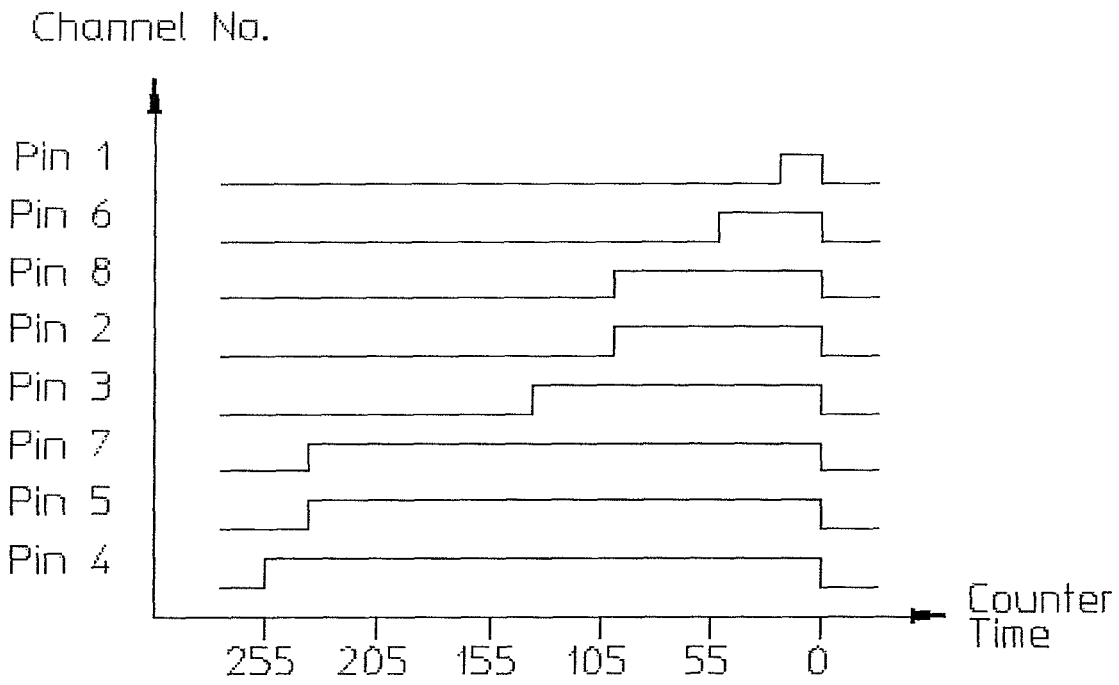
FIG. 7 is the light up table of FIG. 6, expanded to include pin numbers of the slave MCU.
FIG. 8 is a graph showing the status of the pins of the slave MCU versus time by a counter.

The light up table determines the precise moments when the light units U should be turned on. The light units U are turned on by the slave MCU 21/22, which sets its relevant pins to logic high, i.e. "1", at the right time, as shown in the expanded light up table of FIG. 7. The status of the slave MCU pins is shown in FIG. 8, where pulse width determines the light up duration and hence lighting intensity.

The light up table approach allows the MCU to manage a number of pins (channels) "port" by "port" rather than single I/O bit manipulation. The MCU execution time is significantly saved. For the 18 channels slave MCU processor, it only needs to manage 3 ports output (every I/O port has 8 I/O pins for general 8 bit MCU) to refresh all 18 channels. Speed is thus improved. Promoting the efficiency of the MCU minimizes the delay due to calculation and shortens the LED refreshing time.

It is understood that the subject invention is not restricted to the DMX or DMX512 protocol and is applicable to any other network protocols.

The invention has been given by way of example only, and various modifications of and/or alterations to the described embodiment may be made by persons skilled in the art without departing from the scope of the invention as specified in the appended claims.

The invention claimed is:

1. A method of controlling respective light intensity levels of each of N light units, from a first light unit to an Nth light unit, each of the light units producing light at a plurality of controllable intensity levels, the intensity levels ranging from a lowest level, 0, to a highest level, L, based on duration of illumination of the respective light units, the method comprising:

receiving and processing a control signal including a respective light intensity level for each of the N light units, sequentially, in an order from the first light unit to the Nth light unit;

re-arranging the respective light intensity levels of the N light units, of the control signal that has been processed, in accordance with the light intensity levels, in a re-arranged order, from the highest light intensity level to the lowest light intensity level;

counting a predetermined time period sequentially through L time intervals;

turning on the respective light units in the re-arranged order at respective time intervals corresponding to the respective light intensity levels; and turning off all of the light units at the end of the predetermined time period.

2. The method as claimed in claim 1, wherein the light intensity level 0 represents zero duration of illumination, and the light intensity level L represents maximum duration of illumination, which is illumination for all of the predetermined time period.

3. The method as claimed in claim 1, wherein counting the predetermined time period comprises counting down the predetermined time period to zero.

4. The method as claimed in claim 1, wherein turning on the respective light units includes turning on the respective light units based on pulse width modulation.

5. The method as claimed in claim 1, wherein turning on the respective light units includes turning on the respective light units upon starting of respective time intervals.

6. The method as claimed in claim 1, including repeating the steps of claim 1 sequentially and cyclically.

7. The method as claimed in claim 1, wherein the light intensity levels of 0 to L range from 0 to 255.

8. The method as claimed in claim 1, wherein each light unit comprises at least one string of light emitting diodes.

9. The method as claimed in claim 1, including using a control unit, selected from the group consisting of a microprocessor unit, a microcontroller unit, and a micro-computer unit, for controlling the light units, the control unit having a respective output pin for controlling a corresponding one of the light units.

10. The method as claimed in claim 1, including using a master control unit, selected from the group consisting of a microprocessor unit, a microcontroller unit, and a micro-computer unit, for receiving and processing the control signal and a slave control unit, selected from the group consisting of a microprocessor unit, a microcontroller unit, for performing the other steps of claim 1.

11. The method as claimed in claim 10, wherein N is an even number and including using a pair of the slave control units for performing the other steps of claim 1, each slave control unit controlling a respective half of the N light units.

12. The method as claimed in claim 10 including transmitting the control signal, after processing, from the master control unit to the slave control unit, sequentially, for each of the light units, from the first light unit to the Nth light unit, free of identifications, addresses, and channel numbers for the respective light units.

13. A controller controlling respective light intensity levels of each of N light units, from a first light unit to an Nth light unit, each of the light units producing light at a plurality of controllable light intensity levels, from a lowest light intensity level, 0, to a highest light intensity level, L, based on duration of illumination of the respective light units, the controller comprising:

a first processor receiving and processing a control signal including a respective light intensity level for each of the N light units, sequentially, in an order from the first light unit to the Nth light unit;

a second processor receiving the control signal processed by the first processor and re-arranging the respective light intensity levels of the N light units of the control signal processed by the first processor, in accordance with the light intensity levels, in a re-arranged order, from the highest light intensity level to the lowest light intensity level;

a counter counting a predetermined time period sequentially through L time intervals; and an operator turning on the respective light units in the re-arranged order at respective time intervals corresponding to the respective light intensity levels, and turning off all of the light units at the end of the predetermined time period.

14. The controller as claimed in claim 13, wherein the light intensity level 0 represents zero duration of illumination, and the light intensity level L represents maximum duration of illumination, which is illumination for all of the predetermined time period.

15. The controller as claimed in claim 13, wherein the counter counts down the predetermined time period to zero.

16. The controller as claimed in claim 13, wherein the operator turns on the respective light units based on pulse width modulation.

17. The controller as claimed in claim 13, wherein the operator turns on the respective light units upon starting of respective time intervals.

18. The controller as claimed in claim 13, wherein the light intensity levels of 0 to L range from 0 to 255.

19. The controller as claimed in claim 13, wherein each light unit comprises at least one string of light emitting diodes.

20. The controller as claimed in claim 13, wherein the second includes a control unit, selected from the group consisting of a microprocessor, a microcontroller, and a micro-computer, and having a respective output pin for controlling a corresponding one of the light units.

21. The controller as claimed in claim 13, wherein the first processor includes a master control unit, selected from the group consisting of a microprocessor unit, a microcontroller unit, and a micro-computer unit, receiving and processing the control signal, and the second processor, the counter, and the operator are part of a slave control unit, selected from the group consisting of a microprocessor unit, a microcontroller unit, and a micro-computer unit.

22. The controller as claimed in claim 21, wherein

N is an even number, and the second processor includes a pair of the slave control units, and each slave control unit controls a respective half of the N light units.

23. The controller as claimed in claim 21, wherein the control signal, after processing by the master control unit, is transmitted from the master control unit to the slave control unit sequentially, for each of the light units, from the first light unit to the Nth light unit, free of identifications, addresses, and channel numbers for the respective light units.

* * * * *